United States Patent [19]

Hofer

[11] Patent Number: 4,574,028

[45] Date of Patent: Mar. 4, 1986

[54] APPARATUS FOR PRODUCING A CORRUGATED SHEET

[75] Inventor: Otto J. Hofer, Schaan, Liechtenstein

[73] Assignee: Interrondo AG, Grabs, Switzerland

[21] Appl. No.: 573,411

[22] Filed: Jan. 24, 1984

[30] Foreign Application Priority Data

Feb. 10, 1983 [CH] Switzerland ..... 741/83

[51] Int. Cl.[4] ..... B31F 1/20

[52] U.S. Cl. ..... 156/462; 156/469; 156/471; 156/210; 425/396

[58] Field of Search ..... 156/205, 206, 210, 292, 156/462, 469, 470, 471, 285, 468, 553, 72, 183, 204, 474; 264/286; 493/463; 428/179; 425/369, 396; 112/25, 132, 133; 100/237

[56] References Cited

U.S. PATENT DOCUMENTS 2,604,421 7/1952 Widmer et al. ..... 156/471
3,402,092 9/1968 Wiesinger ..... 156/468
3,685,931 8/1972 Craven et al. ..... 425/396

FOREIGN PATENT DOCUMENTS 0743452 3/1933 France .
1120571 7/1956 France .

*Primary Examiner*—Edward Kimlin
*Assistant Examiner*—Ramon R. Hoch
*Attorney, Agent, or Firm*—William R. Hinds

[57] ABSTRACT

In apparatus for producing a corrugated element, each pressing device for deforming a top web of the corrugated element has a separate guide means which is adjustable relative to a plane extending transversely with respect to the direction of forward feed movement of the webs. Each guide means is secured together with drive transmission for its pressing device to a plate. The plates can be adjusted by adjusting screws on opposite sides of the webs, thereby permitting the pressing devices to be adapted to specific operating conditions.

8 Claims, 5 Drawing Figures

APPARATUS FOR PRODUCING A CORRUGATED SHEET

FIELD OF THE INVENTION

The invention relates to apparatus for producing a corrugated element comprising a carrier web and a top web which is arranged in a corrugated configuration thereon, wherein the top web can be deformed and pressed against the carrier web by means of a cyclically operating shaping station having at least two pressing devices which are displaceable in a guide means.

DESCRIPTION OF THE PRIOR ART

Apparatus of that kind has already been known and conventionally used for various purposes, for some time. Thus for example U.S. Pat. No. 3,402,092 describes an apparatus for producing relatively wide corrugated elements which are predominantly used for decorative purposes. However, corrugated elements of that kind are also produced for packaging purposes, where the dimensional accuracy of the individual corrugations is a factor of relatively great importance. An apparatus in which corrugated elements of widely varying configurations can be produced on the same machine is described in detail in European Patent Application No. 82 111 389.1.

A disadvantage of known apparatus is that adjustment of the pressing devices gives rise to problems. Thus for example in above-mentioned U.S. Pat. No. 3,402,092, the two pressing devices are only adjustable in respect of height, and even then, only when the machine is stationary. However, the pressing devices cannot be adjusted relative to each other and relative to the direction of foward feed movement of the webs. In the case of deformation tools which operate at high speed however, it is necessary to be able to adjust the individual tools relative to each other with an extremely high degree of accuracy. That is particularly the case insofar as, with modern equipment, wall thickness and nature of the webs can be interchanged as desired. Shaping tools which are not accurately adjusted rub against each other and can give rise to damage to the webs. In addition, it must be possible for the angle of the pressing devices relative to the direction of forward feed movement to be adjusted precisely as otherwise, after leaving the shaping station, in the limit case the deformed top web describes a slightly curved arc so that as time goes by it deviates more and more from the carrier web.

SUMMARY OF THE INVENTION

The object of the present invention is therefore to avoid the disadvantages of the known art and in particular to provide an apparatus of the kind set forth in the opening part of this specification, wherein the pressing devices can be adjusted to adapt them to the web material to be processed and to the specific operating conditions. That object is achieved, according to the invention by an apparatus for producing a corrugated element comprising a carrier web and a top web which is arranged in a corrugated configuration thereon, wherein the top web can be deformed and pressed against the carrier web by means of a cyclically operating shaping station having at least two pressing devices which are displaceable in a guide means, characterised in that each pressing device has a separate guide means which is displaceable relative to a plane extending transversely with respect to the direction of forward feed movement of the webs.

By virtue of that arrangement, both pressing devices can be adjusted independently of each other, in a manner which is of optimum simplicity. That provides for precise adaptation of the tools to the materials to be processed and to the specific operating conditions. The apparatus permits a particularly rational mode of operation to be achieved if the guide means are displaceable while the pressing means are in operation. In that case, the apparatus can operate at full speed while the guide means are adjusted until the optimum operating conditions are achieved.

That may be attained in a particularly advantageous manner if a guide means has a substantially vertically disposed plate which is mounted on fixed supports on both sides of the webs, wherein on each side of the webs, the relative position of the plate is adjustable with respect to the adjacent support, by at least one adjusting screw. In order to avoid play at the adjustable components, the plate in that arrangement may be displaceable on the supports against a spring bias.

As the plate is adjustable on both sides of the webs, it can be moved relative to the supports on two axes. If for example the plate is adjusted only on one side of the webs, then the adjusted side of the plate moves over a circular path having a radius which corresponds to the distance between the two mounting points of the plate. An adjusting mechanism which compensates for those relative movements in a particularly simple manner may be provided if the plate and the supports, on both sides of the webs, respectively have at least one substantially mutually aligned plane and if a respective yoke member is disposed in the boundary region of the fixed plane of the supports and the displaceable plane of the plate, one side of the yoke member bearing against the support and the other side bearing against the plate, and wherein the yoke member can be pressed against the two planes by means of the adjusting screw.

If each yoke member is in the form of a member which is of substantially U-shaped cross-section, then the support action can be provided over the entire height of the plate.

A particularly stable support mounting is provided if, at a plate, the one yoke member lies in a guide rail on the support and on the plate and if the other yoke member lies in a guide rail only on the support, and bears freely against the plate. In that way, that side of the plate at which both sides of the yoke member lie in guide rails acts as a hinge means, while the fact that the yoke member bears freely against the other side of the plate permits compensation in respect of the arcuate movement relative to the support.

The invention provides a particularly advantageous construction if a crank transmission is disposed at each guide means, for converting a rotary movement into a rectilinear movement for the pressing devices. It will be seen that in that way the guide means is displaced together with the entire transmission so that there is no need also to provide complicated mechanical force transmission arrangement which also perform the relative movement of the guide means with respect to the transmission. The rotary movement to the crank transmission can be easily transmitted with a drive belt which readily permits compensation in respect of relative movements between the drive input and output sides.

DESCRIPTION OF THE DRAWINGS

An embodiment of the invention is described in greater detail hereinafter and illustrated in the accompanying drawings in which.

DESCRIPTION OF THE ILLUSTRATED EXAMPLES

Figure 1:
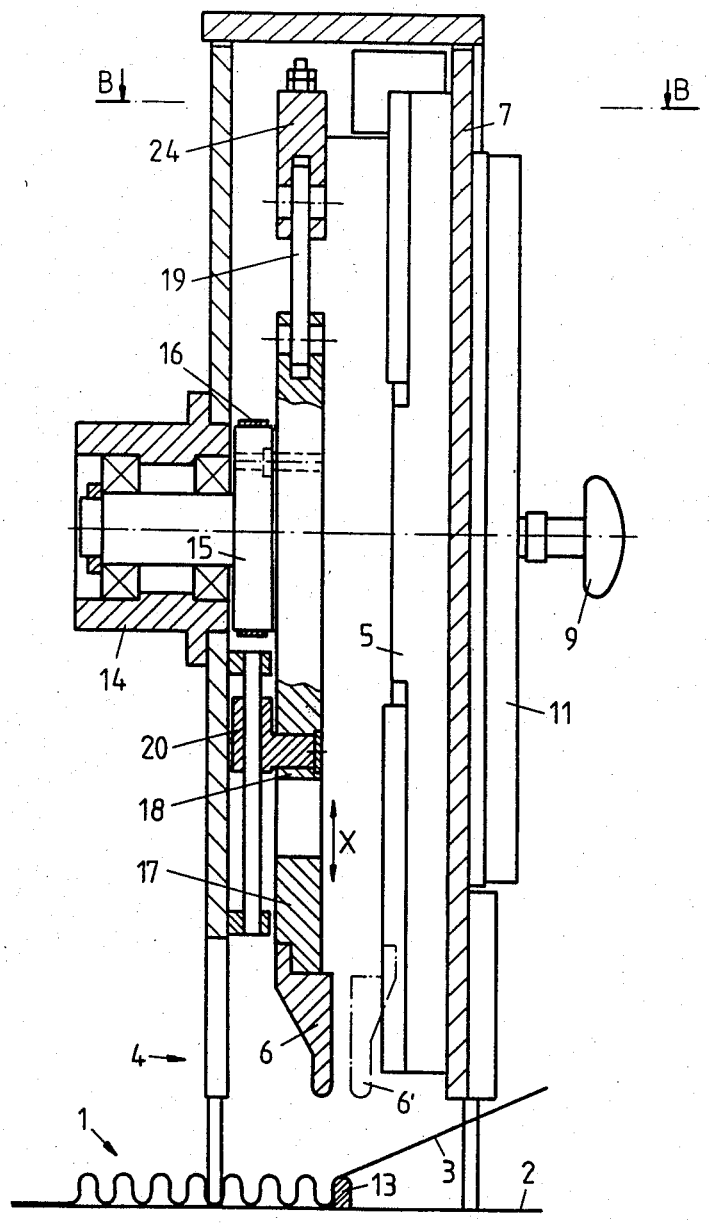
FIG. 1 shows a view of an apparatus according to the invention in cross-section on plane A—A in FIG. 2.

As shown in FIG. 1, in an apparatus according to the invention, a corrugated element 1 is produced from a carrier web 2 which is cyclically fed to a shaping station, and top web 3. The top web 3 is deformed by means of at least two pressing devices 6 and 6′ which also operate cyclically and which deform the top web over a shaping element 13 which can be inserted between the carrier web and the top web, and press the top web against the carrier web. The operating principle and the various possible uses of the apparatus are described in detail in European Patent Application No. 82 111 389.1.

The pressing devices 6 and 6′ are each secured to a respective tool holder 17 which is moved up and down in the direction indicated by the arrow X by a crank transmission which will be described hereinafter. The tool holder 17 is in turn guided by a guide means having a plate 7. Secured to the plate 7 is the crank transmission comprising a bearing arrangement 14, an eccentric disc 15, a connecting rod 18 and a straight guide 20.

Figure 2:
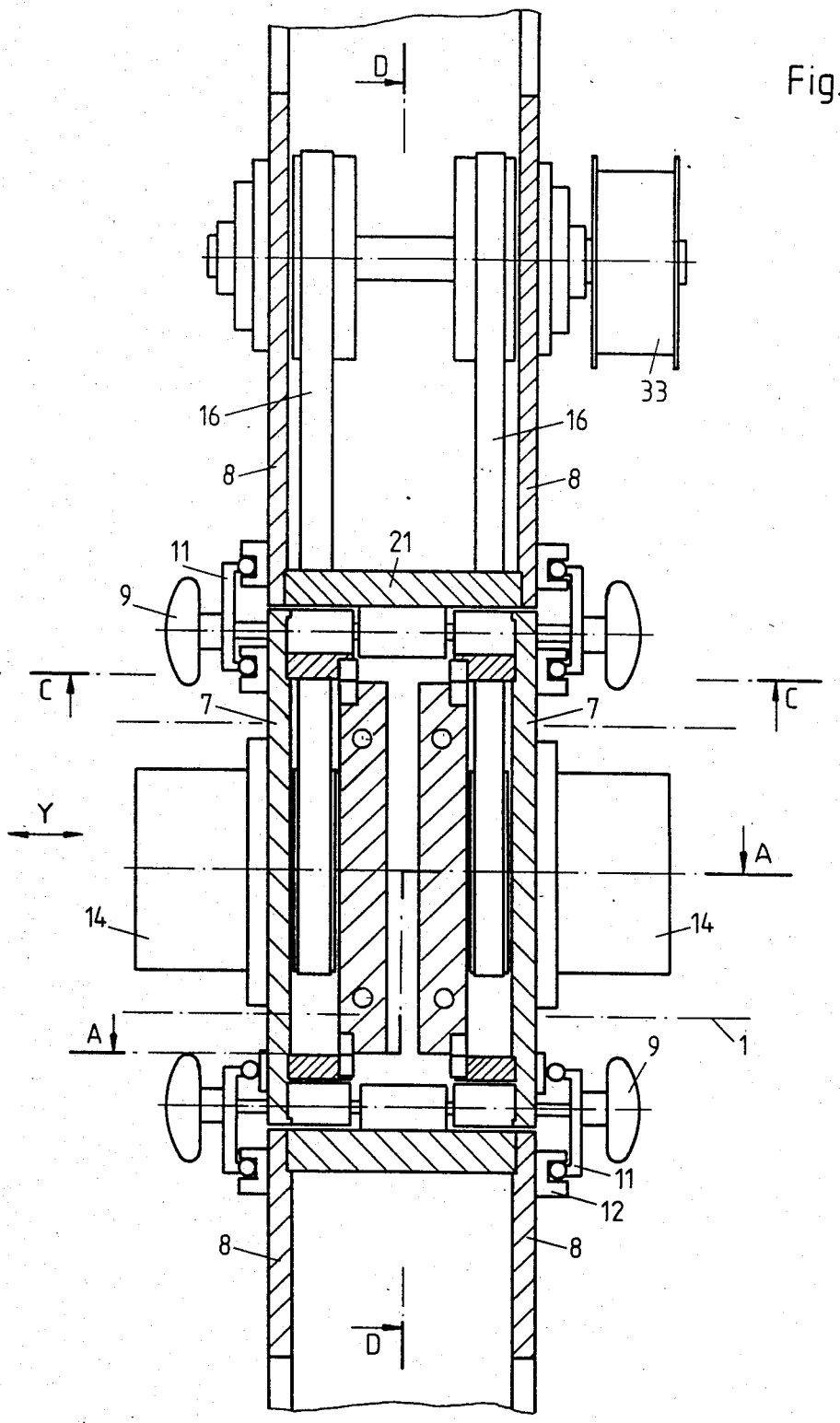
FIG. 2 shows a plan view onto a section taken on plane B—B in FIG. 1.

As can be particularly clearly seen from FIG. 2, each plate 7 is displaceable relative to respective supports 8 arranged on both sides of the webs. In the horizontal plane, the two plates 7 lie on carrier members 22 on both sides of the webs. The members 22 can be seen from FIGS. 3 and 4. The members 22 are arranged on both sides of a central carrier rail or bar 21. Provided on the guide means 5 are recesses 31 into which the members 22 can engage. As this arrangement is a slide bearing arrangement, it will be seen that the surfaces of the member 22 and the guide means 5 which bear against each other must be suitably finely machined.

Figure 3:
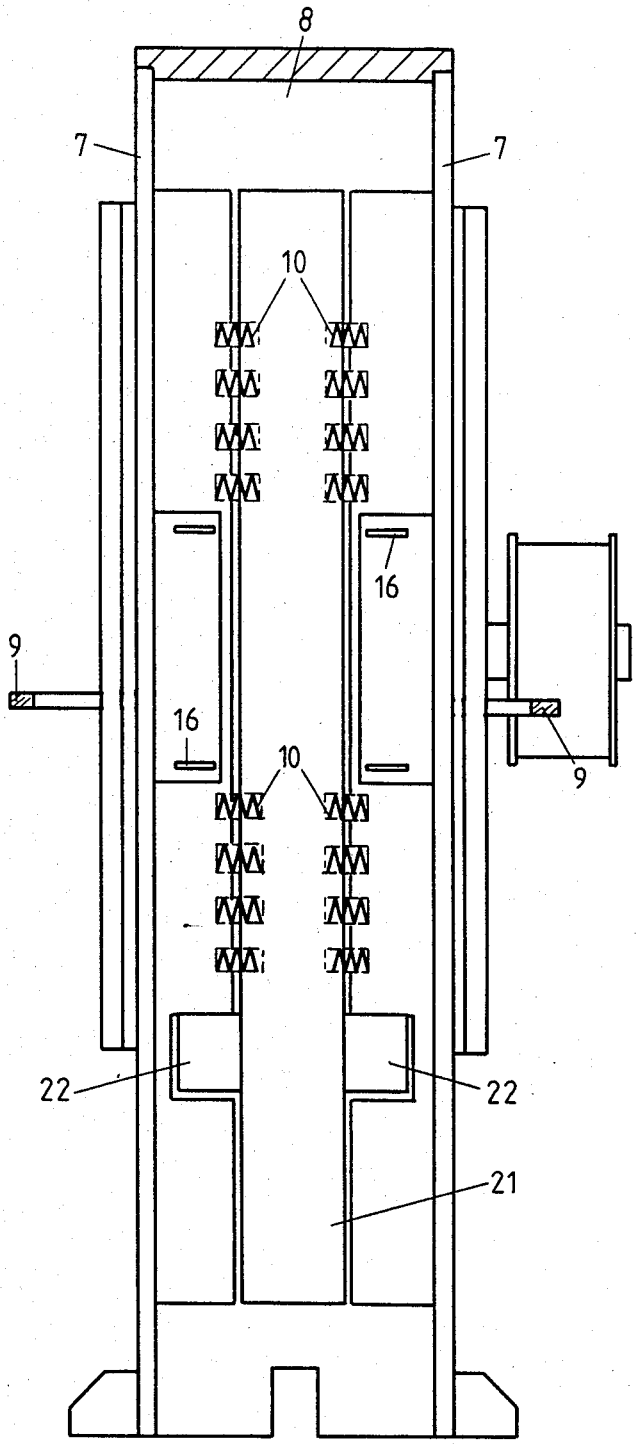
FIG. 3 shows a view in cross-section on plane C—C in FIG. 2.

The above-described mounting arrangement permits the plates 7 to be adjusted in the direction indicated by the arrow Y and also relative to a plane extending transversely with respect to the direction of forward movement of the webs. In that connection, adjustment is effected by means of adjusting screws 9 and with an adjusting mechanism which is described in greater detail with reference to FIG. 5. The adjusting screws 9 extend with play through a bore 32 in the plate 7 and the guide means 5 and are screwed into the holding rail or bar 21. Disposed between the holding rail or bar 21 and the guide means 5 is a plurality of compression springs 10 which press the guide means 5 away from the rail or bar 21. The array of springs 10 is shown in FIG. 3.

Figure 5:
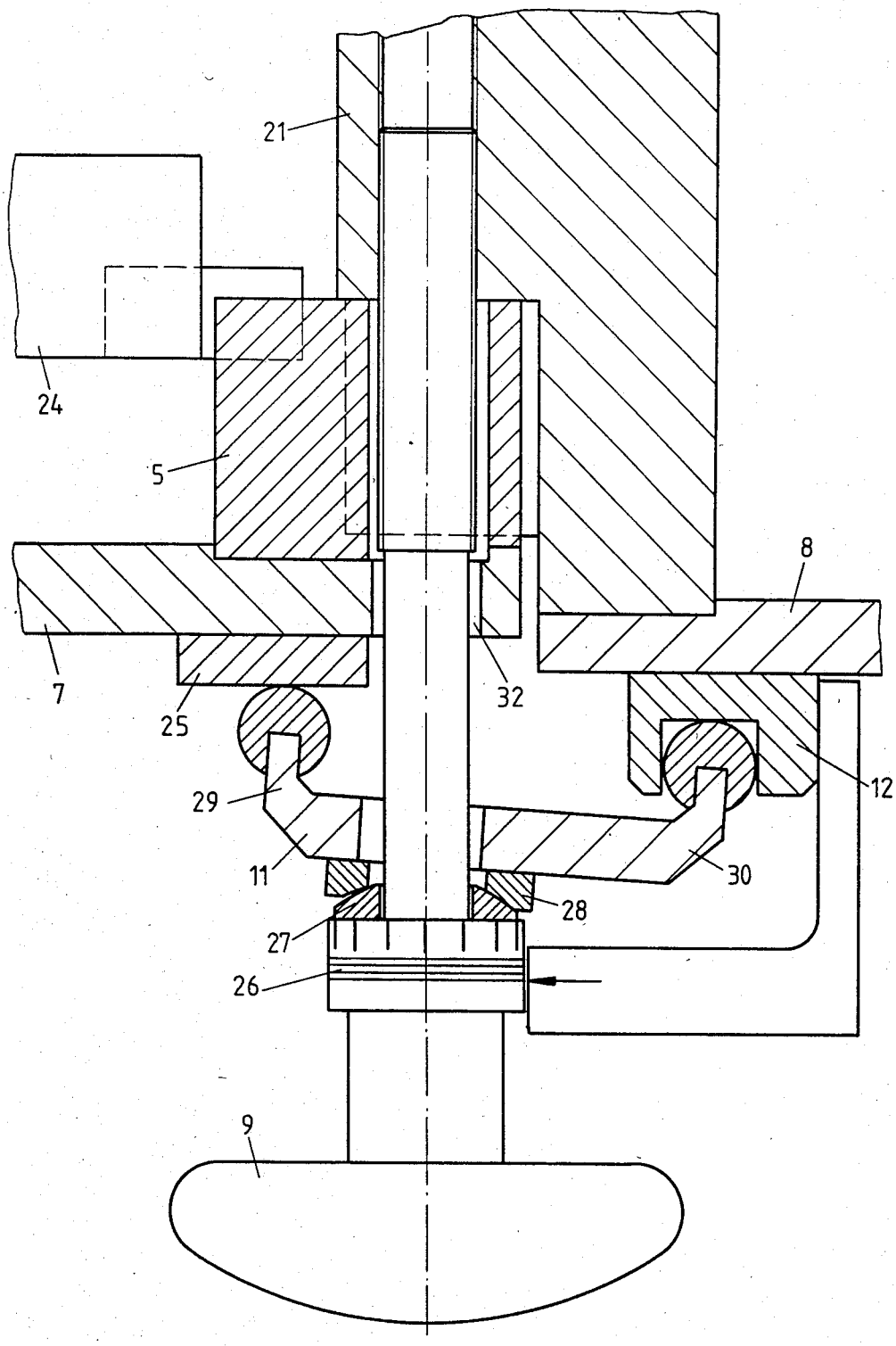
FIG. 5 shows a view in cross-section through an adjusting screw with yoke member, on an enlarged scale.

As can be seen from FIGS. 2 and 5, the plates 7 and the supports 8 have a substantially mutually aligning plane. The two planes which are displaceable relative to each other are bridged by means of a yoke member 11 comprising a substantially U-shaped component. Each yoke member has a bearing seat 28 for the spherical cooperating bearing member 27 on the adjusting screw 9. The two ends of the yoke member are of round cross-section so as to be able to accommodate rotary movements of the yoke member. The ends of a yoke member 11 lie in guide rails 12 which extend substantially over the length of the yoke member 11. In the case of a respective yoke member, the guide rail 12 on the plate 7 is replaced by a sliding bearing surface 25 so that relative movements in the common plane of the plate 7 and the support 8 can also be accommodated.

As shown in FIG. 5, the plate side 29 of the yoke member 11 bears against the surface 25 while the support side 30 lies in the U-shaped guide rail 12. Disposed on the adjusting screw 9 is a scale 26 which permits a given setting position to be read off. If a plate 7 is to be displaced in a plane precisely normal to the direction of forward feed movement of the webs, then the two adjusting screws 9 on both sides of the webs must be turned at the same time. It will be seen that turning an adjusting screw 9 on only one side of the webs causes the plate 7 to take up an inclined position relative to the direction of forward feed movement.

The eccentric disc 15 of the crank transmission is mounted in a bearing arrangement 14 which has for example a pair of ball bearing assemblies or other suitable rolling bearing assemblies. The eccentric disc 15 is driven by a drive belt 16. As can be seen in particular from FIG. 3, openings are provided in the guide means 5, for the drive belts 16. The drive belts go to a drive device 33 (not described in greater detail herein) which is disposed on a support 8. A resilient drive belt 16 is readily capable of accommodating relative movements between the drive input side and the drive output side.

Figure 4:
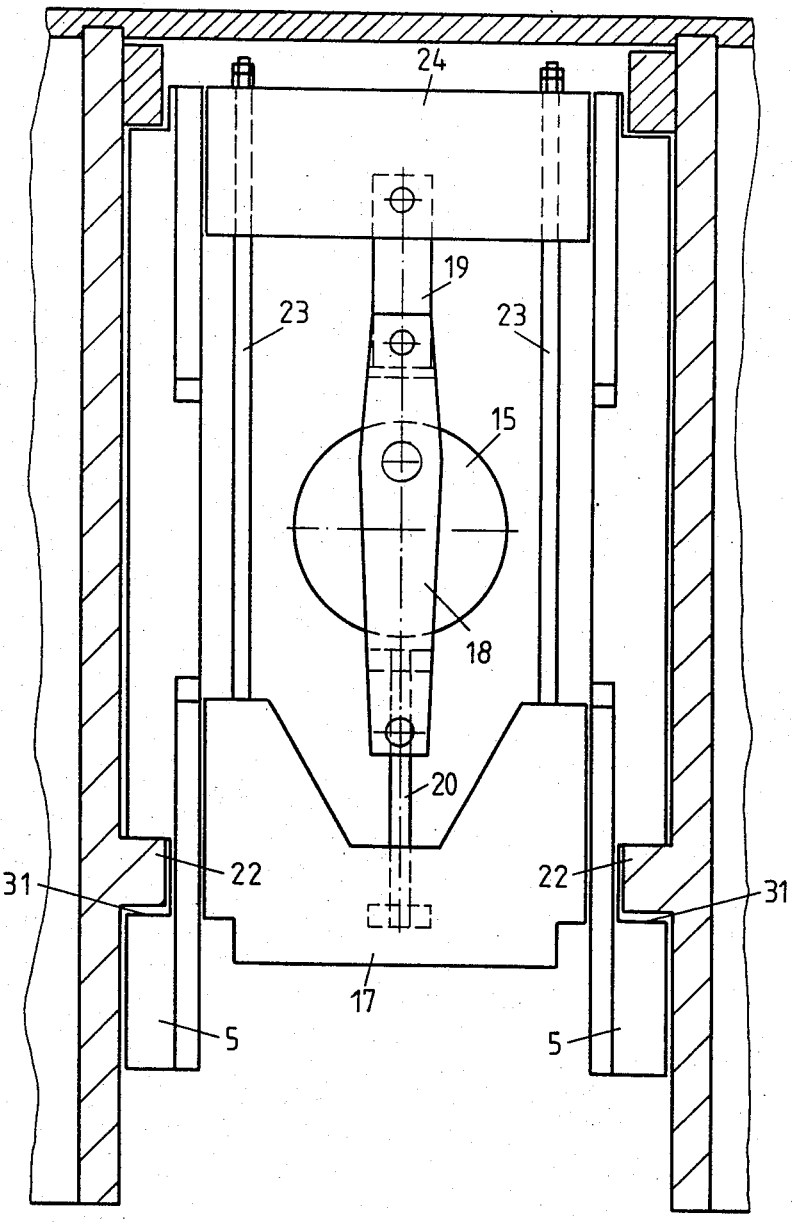
FIG. 4 shows a view in cross-section taken on plane D—D in FIG. 2.

The eccentric disc 15 moves a connecting rod 18, as can be seen in particular from FIG. 4. The lower end of the connecting rod 18 is guided in a rectilinear guide 20. The upper end of the connecting rod is rotationally movably connected to a draw bar 19 which in turn is secured to a connecting block 24. In that way the crank transmission becomes a coupling transmission arrangement wherein the coupling point between the draw bar and the connecting rod remains at rest during a given angular movement of the eccentric disc 15. That gives a lower rest position in respect of the pressing means, which is required for pressing the top web against the carrier web. The tool holder 17 is secured to the connecting block 24 by means of two screwthreaded rods 23. In order to reduce the structural height of the arrangement, the tool holder 17 has a substantially V-shaped opening in which the lower end of the connecting rod 18 moves, in the upper limit position of the tool holder 17. The arrangement of the crank transmission on the displaceable plate provides, in a surprisingly simple manner, for adjustment of the pressing means while the apparatus is in full operation.

I claim:

1. Apparatus for producing a corrugated element comprising means defining a path along which a carrier web and a superposed top web are to be fed longitudinally and a cyclically operating shaping station extending transversely across said path for forming corrugations in the top web, said shaping station including at least two vertically reciprocable pressing devices extending transversely over said path for impressing corrugations in the top web, at least two separate guide means allocated respectively to said pressing devices for guiding them in their vertical reciprocation, means for reciprocating said pressing devices in said guide means, said guide means being mounted for displacement relative to each other and to a plane extending transversely with respect to said path, and adjusting means for independently adjusting the position of said guide means relative to said plane and to each other, said guide means interacting with said pressing devices such that the displacement of the guide means relative to the transversely extending plane results in a corresponding displacement of said pressing devices relative to each other and said transversely extending plane.

2. Apparatus according to claim 1, in which each said adjusting means is mounted for the position of its respective guide means to be adjusted while said pressing devices are in operation.

3. Apparatus according to claim 2, including respectively on opposite sides of said path two pairs of fixed supports, the supports in each pair being spaced apart along a respective side of said path, each said guide means including a substantially vertically disposed plate interposed between the supports in a pair of said supports, and said adjusting means comprising four screw mechanisms, each including at least one adjusting screw and each said screw mechanism being interposed between a respective one of said supports and the edge area of the plate adjacent said one of said supports.

4. Apparatus according to claim 1 including respectively on opposite sides of said path two pairs of fixed supports, the supports in each pair being spaced apart along a respective side of said path, each said guide means including a substantially vertically disposed plate interposed between the supports in a respective pair of said supports, springs interposed between each said plate and each of the pair of supports adjacent said plate, and said adjusting means comprising four screw mechanisms, each including at least one adjusting screw, and each said screw mechanism being interposed between a respective one of said supports and the edge area of the plate adjacent said one of said supports, whereby each plate is independently displaceable against a spring bias on its respective pair of supports relative to the other plate and to a plane extending transversely with respect to said path.

5. Apparatus according to claim 4, in which on each side of said path, said pair of supports present mutually aligned planes at opposite edges of said interposed displaceable plate and in which each said screw mechanism comprises a yoke member of which one side bears against the mutually aligned plane of one of said supports and the other side bears against said displaceable plate, said adjusting screw being arranged to press said yoke against said mutually aligned plane and against said displaceable plate to hold said displaceable plate in adjusted position.

6. Apparatus according to claim 4, in which on each side of said path, said pair of supports present mutually aligned planes at opposite edges of said interposed displaceable plate and in which each said screw mechanism comprises a V-shaped yoke member of which one arm bears against the mutually aligned plane of one of said supports and the other arm bears against said displaceable plate, said adjusting screw being arranged to press one arm of said yoke against said mutually aligned plane and the other arm of said yoke against said displaceable plate to hold said displaceable plate in adjusted position.

7. Apparatus according to claim 4, in which on each side of said path, said pair of supports present mutually aligned planes at opposite edges of said interposed displaceable plate and in which each said screw mechanism comprises a V-shaped yoke member of which one arm bears against the mutually aligned plane of one of said supports and the other arm bears against said displaceable plate, the apparatus further comprising vertical guide rails respectively secured to each support for guiding the said one arm of the associated yoke and also comprising two individual vertical guide rails respectively secured to said plates, each individual guide rail being located adjacent the one of said first-mentioned guide rails on an adjacent support at one edge of said plate and each individual guide rail being arranged to guide the said second arm of the associated yoke, the said second arm of the yoke associated with the support at the other edge of said plate being arranged to bear freely on that plate, said adjusting screw of each yoke being arranged to press said one arm of that yoke against one of said supports and said second arm against the adjacent one of said displaceable plates.

8. Apparatus according to claim 1 comprising crank transmission mechanism for converting rotary movement into rectilinear reciprocating movement, said transmission mechanism being connected to said pressing devices for operating them and being mounted between said guide means allocated respectively to said pressing devices.

* * * * *